US006922181B2

(12) United States Patent
Tanaka et al.

(10) Patent No.: US 6,922,181 B2
(45) Date of Patent: Jul. 26, 2005

(54) METHOD OF CONTROLLING LUMINANCE OF DISPLAY PANEL

(75) Inventors: Yoshito Tanaka, Tokyo (JP); Tadashi Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 315 days.

(21) Appl. No.: 10/194,051

(22) Filed: Jul. 15, 2002

(65) Prior Publication Data

US 2003/0052841 A1 Mar. 20, 2003

(30) Foreign Application Priority Data

Jul. 19, 2001 (JP) ..... 2001-220499

(51) Int. Cl.[7] ..... G09G 3/28
(52) U.S. Cl. ..... 345/63; 345/60; 345/690
(58) Field of Search ..... 345/60–68, 690–693, 345/204, 208; 315/169.1, 169.4

(56) References Cited

U.S. PATENT DOCUMENTS 5,757,343 A * 5/1998 Nagakubo ..... 345/63
6,680,716 B2 * 1/2004 Nakamura ..... 345/60

FOREIGN PATENT DOCUMENTS

EP 000833299 A1 * 4/1998
JP 10-153982 A 6/1998

* cited by examiner

*Primary Examiner*—Regina Liang
(74) *Attorney, Agent, or Firm*—Sughrue Mion, PLLC

(57) ABSTRACT

In power saving luminance control that the maximum luminance of one field is varied according to an average luminance level of an image, the luminance of a subfield at the minimum luminance level is fixed to a certain value without depending upon the variation of the maximum luminance of one field. Hereby, even if luminance control that the maximum luminance of one field is enhanced in an image the average luminance level of which is low is made, a gradation characteristic in a low luminance region is improved.

6 Claims, 7 Drawing Sheets

METHOD OF CONTROLLING LUMINANCE OF DISPLAY PANEL

BACKGROUND OF THE INVENTION

1. Field of the Invention

The present invention relates to a method of controlling the luminance of a plasma display panel that represents gradation using a subfield method or the luminance of a display panel of a digital micromirror device and others, particularly relates to a luminance control method of varying display luminance according to the luminance level of a displayed image.

2. Description of the Prior Art

For an example of a display device using a subfield method, a plasma display panel will be described below.

Referring to the drawings, a conventional type plasma display panel, its driving method and its luminance control method will be described below.

FIG. 1 is a partial sectional view showing the conventional type plasma display panel.

Two front and back substrates 1*a* and 1*b* respectively made of glass are provided to the plasma display panel.

A transparent scanning electrode 2 and a sustain electrode 3 are formed on the substrate 1*a* and a bus electrode 4 is arranged to reduce the resistance values of these electrodes so that it is overlapped with the scanning electrode 2 and the sustain electrode 3.

A first dielectric layer 9 covering the scanning electrode 2 and the sustain electrode 3 is also provided and a protective layer 10 made of magnesium oxide and others for protecting the dielectric layer 9 from discharge is formed.

A data electrode 5 extended perpendicularly to the scanning electrode 2 and the sustain electrode 3 is formed on the substrate 1*b*.

A second dielectric layer 11 covering the data electrode 5 is also provided.

A partition 7 extended in the same direction as the data electrode 5 for delimiting a display cell to be a unit of display is formed on the dielectric layer 11.

Further, a phosphor layer 8 that converts ultraviolet rays generated by the discharge of gas to visible light is formed on the side of the partition 7 and on the surface on which no partition 7 is formed of the dielectric layer 11.

Space put between the substrates 1*a* and 1*b* and partitioned by the partition 7 is discharged space 6 in which discharged gas made of helium, neon or xenon, or mixed gas of these is filled.

In the plasma display panel configured as described above, surface discharge 100 occurs between the scanning electrode 2 and the sustain electrode 3.

Next, various selective display operations of a display cell will be described.

FIG. 2 is a time chart showing a voltage pulse applied to each electrode in a conventional type driving method.

As shown in FIG. 2, a period A is a priming period for facilitating the occurrence of discharge in a succeeding selective operational period, a period B is the selective operational period for selecting turning on/off display in each display cell, a period C is a sustain period for enabling display discharge in selected all display cells and a period D is a sustain elimination period for halting the display discharge.

In the conventional type driving method, the reference potential of a surface electrode formed by the scanning electrode 2 and the sustain electrode 3 is equivalent to sustain voltage Vs for maintaining discharge in the sustain period C.

Therefore, for the scanning electrode 2 and the sustain electrode 3, higher potential than the sustain voltage Vs is represented as positive and lower potential is represented as negative.

The electric potential of the data electrode 5 is 0 V.

First, in the priming period A, a positive sawtooth priming pulse Pps is applied to the scanning electrode 2 and simultaneously, a negative rectangular priming pulse Ppc is applied to the sustain electrode 3.

The peak value of the priming pulses is set to a value that exceeds discharge starting threshold voltage between the scanning electrode 2 and the sustain electrode 3.

Therefore, the voltage of the sawtooth priming pulse Pps rises by applying the priming pulses Pps and Ppc to each electrode and when voltage between both electrodes exceeds the discharge starting threshold voltage, weak discharge occurs between the scanning electrode 2 and the sustain electrode 3.

As a result, a negative wall charge is generated on the scanning electrode 2 and a positive wall charge is generated on the sustain electrode 3.

A negative sawtooth priming elimination pulse Ppe is applied to the scanning electrode 2 next to the application of the priming pulse Pps.

At this time, the electric potential of the sustain electrode 3 is fixed to the sustain voltage Vs.

The wall charges generated on the scanning electrode 2 and the sustain electrode 3 are erased by the application of the priming elimination pulse Ppe.

The adjustment of the wall charge for satisfactorily executing operation in the next process such as selective operation and sustain discharge is included in the elimination of the wall charges in the priming period A.

Next, in the selective operational period B, after all scanning electrodes 2 are once held base potential Vbw, a negative scanning pulse Pw is sequentially applied to each scanning electrode 2 and a data pulse Pd according to display data is applied to the data electrode 5.

For this while, the sustain electrode 3 is held positive potential Vsw.

The ultimate potential of the scanning pulse Pw and the data pulse Pd is set so that voltage between opposite electrodes formed by the scanning electrode 2 and the data electrode 5 does not exceed the discharge starting threshold voltage when an either pulse is applied and exceeds the discharge starting threshold voltage when both pulses are superposed.

The electric potential Vsw of the sustain electrode 3 in the selective operational period B is set so that it does not exceed the discharge starting threshold voltage between the scanning electrode 2 and the sustain electrode 3 even if the scanning pulse Pw is superposed.

Therefore, in only a display cell to which the data pulse Pd is applied at the same time as the application of the scanning pulse Pw, opposite discharge occurs between the scanning electrode 2 and the data electrode 5.

At this time, as there is potential difference by the scanning pulse Pw and Vsw between the scanning electrode 2 and the sustain electrode 3, discharge is triggered by the opposite discharge and also occurs between the scanning electrode 2 and the sustain electrode 3.

This discharge is writing discharge.

As a result, in a selected display cell 12, a positive wall charge is generated on the scanning electrode 2 and a negative wall charge is generated on the sustain electrode 3.

Afterward, in the sustain period C, the sustain pulse Pps the peak value of which is equivalent to the sustain voltage Vs and each phase of the sustain pulse applied to each scanning electrode and the sustain pulse applied to each sustain electrode of which is inverted is applied to all scanning electrodes 2 and all sustain electrodes 3.

The sustain voltage Vs is set to voltage at which discharge occurs in case wall voltage generated on the surface electrode by the writing discharge in the selective operational period B is superposed on the sustain voltage Vs and at which surface electrode potential does not exceed the discharge starting threshold voltage and no discharge occurs in case such a wall charge is not superposed.

Therefore, in only the display cell 12 in which writing discharge occurs in the selective operational period B and a wall charge is generated, sustain discharge for display occurs.

In the succeeding sustain elimination period D, the voltage of the sustain electrode 3 is fixed to the sustain voltage Vs and a negative sawtooth sustain elimination pulse Pe is applied to the scanning electrode 2.

In this process, the wall charge on the surface electrode is erased and control is returned to an initial state, that is, a state before the priming pulses Pps and Ppc are applied in the priming period A.

The adjustment of the wall charge for satisfactorily executing operation in the next process is also included in the elimination of the wall charge in the sustain elimination period D.

In addition to the method in which the selective operational period and the sustain period are separated in time, a driving method in which these operations are mixed is also adopted, however, from the viewpoint of an individual display cell, the methods are similar in that the selective operational period is provided after the priming and next, the sustain period is provided.

A subfield method is used for the gradation display of the plasma display.

The reason is that in an AC-type plasma display, it is difficult to vary voltage for display luminance and for luminance modulation, the frequency of emission is required to be varied.

According to the subfield method, one image having gradation is analyzed into plural binary display images, they are continuously displayed at high speed and the one image is reproduced as a multi-gradation image by visual integral effect.

FIG. 3 schematically shows a part of a circuit for converting an analog television vide signal to a signal for driving the plasma display panel.

As the plasma display has no gamma characteristic in output, the correction of an output level is first made in a gamma correction circuit.

Next, the luminance level of each color of RGB is converted to a digital signal by an A/D converter.

The conversion is made every eight bits for normal full color display.

Next, the luminance level of each color of RGB is further converted to a subfield selecting signal in a subfield coding circuit.

For example, in case an eight-bit image having 256 gradations is represented in eight subfields, a video signal is digitized to be a binary code acquired by representing image luminance signal data at the ratio of 1:2:4:8:16:32:64:128, and a subfield according to the number of sustain cycles in which luminance according to each gradation is given is allocated.

The number of sustain cycles of each subfield is adjusted so that in a subfield SF1 at the head, display at the least luminance is made, in order, in SF2, display at luminance equivalent to the double in SF1 is made and in SF8, the most luminance is given.

Hereby, a subfield is selected according to the gradation level of each discharge cell and full color display is realized.

In an actual plasma display for full color display, when an animation is displayed, a false contour in an animation proper to the subfield method is caused.

The principle of the occurrence of a false contour in an animation will be described below.

FIG. 4 is a time chart showing a state of the emission of a cell for explaining the principle of the occurrence of the false contour in an animation.

In FIG. 4, the x-axis shows time and the y-axis shows continuous display cells.

For gradations, a case that 64 gradations represented by six bits are represented in six subfields in a weighted binary code will be briefly described below.

A unit of display on a time base is a field and each field is divided into six subfields differently weighted.

In FIG. 4, a case that an image which includes 31 and 32 gradations and the luminance of which smoothly varies move on the screen of the plasma display panel described above is represented.

The subfields shaded in FIG. 4 are emitted subfields and a mark of ▲ shows the center of the gravity of emission which is a mean position of emission in a field.

A number on the side of the center of the gravity of emission denotes a value of the gradation of the subfield.

As shown in FIG. 4, as a field advances from m to m+2 via m+1, an image moves in a direction from n+3 to n via n+2 and n+1.

At this time, in a cell n+1, as a gradation varies from 31 (111110) to 32 (000001) from the field m to the field m+1, the center of the gravity of emission moves from a front half to a rear half in the field (in this case, a subfield in which emission occurs is represented as 1 and a subfield in which no emission occurs is represented as 0).

At this time, in the rear half of the field m and the front half of the field m+1, no emission occurs and a non-display period for one field occurs as encircled by a dotted line.

The non-display period moves with the movement of an image and is recognized as if a black dot (or a black line) moved.

In case a direction in which an image moves is reverse, a full-display period (not illustrated) is recognized as if a white dot (or a white line) moved instead.

As described above, a phenomenon that a contour that does not exist originally in an image appears is called a false contour of an animation.

To prevent the occurrence of such a false contour of an animation, it is effective to avoid the rapid change of the center of the gravity of emission in a field.

For example, a method of increasing the number of subfields so that the number is more than the number of gradation bits and weighting each subfield so that redundancy different from a binary is added is used.

In this case, to realize the display of 256 gradations, the number of subfields exceeding 9 is required.

Such technique is disclosed in Japanese published unexamined patent application No. Hei 10-153982 (which corresponds to U.S. Pat. No. 6,323,880B1 issued on Nov. 27, 2001) for example.

As the luminous efficiency of the plasma display is not high so much, large power is required in case the whole panel is light such as a case of total white display, and a problem of consumed power and a problem of the heat of the panel and a circuit occur.

Therefore, the control of luminance for clear display in which the luminance of full white display is reduced and peak luminance in case the average luminance of the screen is low is enhanced is adopted in the plasma display.

The control of luminance is a method of detecting APL which is an average luminance level of the whole screen and varying the number of sustain discharge cycles of each subfield according to it.

That is, in case APL is low, the number of sustain discharge cycles for one field is increased to realize the display of high luminance and in case APL is high, the number of sustain discharge cycles for one field is reduced to reduce power consumption by emission.

Table 1 shows relation between APL and the number of sustain cycles of each subfield in case 256 gradations are represented by 12 subfields.

In this example, APL consists of 4 steps, the lowest level is APL 0 and a state close to total white is APL 3.

In the state of total white, the number of sustain cycles is 255 even if a luminance level is 255, which is the maximum luminance level. On the other hand, and the number of sustain cycles of a luminance level 255 is 1020 at APL 0 at which peak luminance is realized, sustain pulses of the quadruple number are applied, compared with the number of sustain pulses applied in full white display and peak luminance close to the quadruple of the luminance of full white is realized.

TABLE 1

| APL | SF1 | SF2 | SF3 | SF4 | SF5 | SF6 | SF7 | SF8 | SF9 | SF10 | SF11 | SF12 | Total |
|---|---|---|---|---|---|---|---|---|---|---|---|---|---|
| 3 | 1 | 2 | 4 | 8 | 12 | 16 | 21 | 26 | 32 | 38 | 44 | 51 | 255 |
| 2 | 2 | 4 | 8 | 16 | 24 | 32 | 42 | 52 | 64 | 76 | 88 | 102 | 510 |
| 1 | 3 | 6 | 12 | 24 | 36 | 48 | 63 | 78 | 96 | 114 | 132 | 153 | 765 |
| 0 | 4 | 8 | 16 | 32 | 48 | 64 | 84 | 104 | 128 | 152 | 176 | 204 | 1020 |

The maximum power as a display is in total white display and in case APL is low, peak luminance can be increased without increasing maximum consumed power.

There are various methods of detecting APL, however, in the case of the plasma display, luminance data is based upon a digital signal and APL can be easily detected by simple digital signal processing.

The number of sustain cycles of each subfield corresponding to each APL can be easily set using a look-up table (LUT).

In the meantime, relation between the luminance level of each pixel and coding for selecting a subfield is uniquely defined independent of APL and is set using LUT and others.

A luminance control method of controlling the number of sustain cycles based upon such information corresponding to an average luminance level of an image, reducing maximum power consumption and increasing peak luminance is called a power saving method and a peak luminance increasing method (PLE) and is also disclosed in Japanese published unexamined patent application No. 2000-322025 for example.

In this specification, the method is called PLE.

However, the luminance control method of the conventional type display panel has the following problems.

The luminance of a plasma display panel has been enhanced year by year and a representable minimum luminance level has been also enhanced according to it.

In such a case, when luminance is controlled using PLE, when luminance is controlled using PLE, a minimum luminance level in case APL is low has a large value.

FIG. 5 shows relation between each luminance level at APL 0 and at APL 3 and actual luminance.

FIG. 5 shows a state of a relatively low luminance level.

As clear from FIG. 5, a step of the variation of luminance at APL 0 is quadruple, compared with that at APL 3.

For example, if a minimum luminance level representable as a plasma display panel, that is, a luminance level in case the number of sustain cycles is one is 1 cd/m$^2$, a minimum luminance level at APL 0, that is, a step of the variation of luminance is 4 cd/m$^2$.

An image of APL 0 is often a relatively dark image.

In the meantime, the variation of luminance of 4 cd/m$^2$ is a value visible as large difference in luminance and particularly, in a dark image, the variation seems remarkable.

Therefore, though 256 gradations are reproduced at any APL, there is a problem that gradation in a dark image is deteriorated in case APL is low and the dark image is recognized as an image poor in gradation.

To prevent such deterioration of gradation, there is also a method of complementing a gradation based upon an original signal and enhancing gradation based upon the information using a spatial and temporal method such as the error diffusion.

According to such a method, average gradation is improved, however, a problem that as emission of a large luminance step discretely occurs, an image seems rough is left.

SUMMARY OF THE INVENTION

The invention is made in view of the problems in the prior art and the object is to provide a method of controlling the luminance of a display panel in which PLE for controlling the frequency of sustain discharge according to the average luminance (APL) of a displayed screen is further improved, smoothness in gradation display is improved, enhancing peak luminance, reducing consumed power and further, maintaining performance that inhibits a false contour of an animation and a plasma display that enables clear display can be realized.

A method of controlling the luminance of a display panel according to a first invention of the invention provided to solve the problems is based upon a method of controlling the luminance of a display panel of dividing one field into plural subfields, setting two or more types of weighting to the subfield, representing gradation by selecting whether each subfield is to be displayed or not and varying the peak luminance of one field according to an average luminance level of input image data by selecting two or more types of weighting and is characterized in that the rate of change in two or more types of weighting of the weight of one or more subfields on the subordinate side of the subfields is set so that it is smaller than the rate of change in two or more types of weighting of the weight of subfields on the superordinate side.

Peak luminance can be increased, holding gradation representation ability at low luminance by setting the rate of change in two or more types of weighting of the weight of one or more subfields on the subordinate side of plural subfields so that it is smaller than the rate of change in two or more types of weighting of the weight of subfields on the superordinate side.

A method of controlling the luminance of the display panel according to a second invention of the invention provided to solve the problems is based upon the method of controlling the luminance of the display panel according to the first invention and is characterized in that the weight of one or more subfields on the subordinate side of the plural subfields is fixed in two or more types of weighting.

Peak luminance can be increased by fixing the weight of one or more subfields on the subordinate side of plural subfields in two or more types of weighting, holding gradation representation ability at low luminance.

A method of controlling the luminance of the display panel according to a third invention of the invention provided to solve the problems is based upon the method of controlling the luminance of the display panel according to the first or second invention and is characterized in that the weighting of subfields on the subordinate side starting from the least-significant subfield having the least weight is set according to a binary system.

As the weighting of subfields on the subordinate side starting from the least-significant subfield having the least weight complies with a binary system, conventional type coding can be used and there is no redundancy.

A method of controlling the luminance of the display panel according to a fourth invention of the invention provided to solve the problems is based upon the methods of controlling the luminance of the display panel according to the first to third inventions and is characterized in that a range of display gradations made by selecting whether each subfield is to be displayed or not is determined every average luminance level.

As a range of display gradations made by selecting whether each subfield is to be displayed or not is determined every average luminance level, a gradation can be made by a satisfactory set.

A method of controlling the luminance of the display panel according to a fifth invention of the invention provided to solve the problems is based upon the method of controlling the luminance of the display panel according to the fourth invention and is characterized in that in the case of display at low luminance, all displayable gradations are used and in the case of display at high luminance, a part of displayable gradations is used.

A set of subfields can be made further satisfactory by using all displayable gradations in the case of display at low luminance and using a part of displayable gradations in the case of display at high luminance.

A method of controlling the luminance of the display panel according to a sixth invention of the invention provided to solve the problems is based upon the methods of controlling the luminance of the display panel according to the first to fifth inventions and is characterized in that the display panel is a plasma display panel (PDP).

As the display panel is PDP, desired action upon PDP is acquired.

DETAILED DESCRIPTION OF THE PREFERRED EMBODIMENTS

First Embodiment

Figure 1:
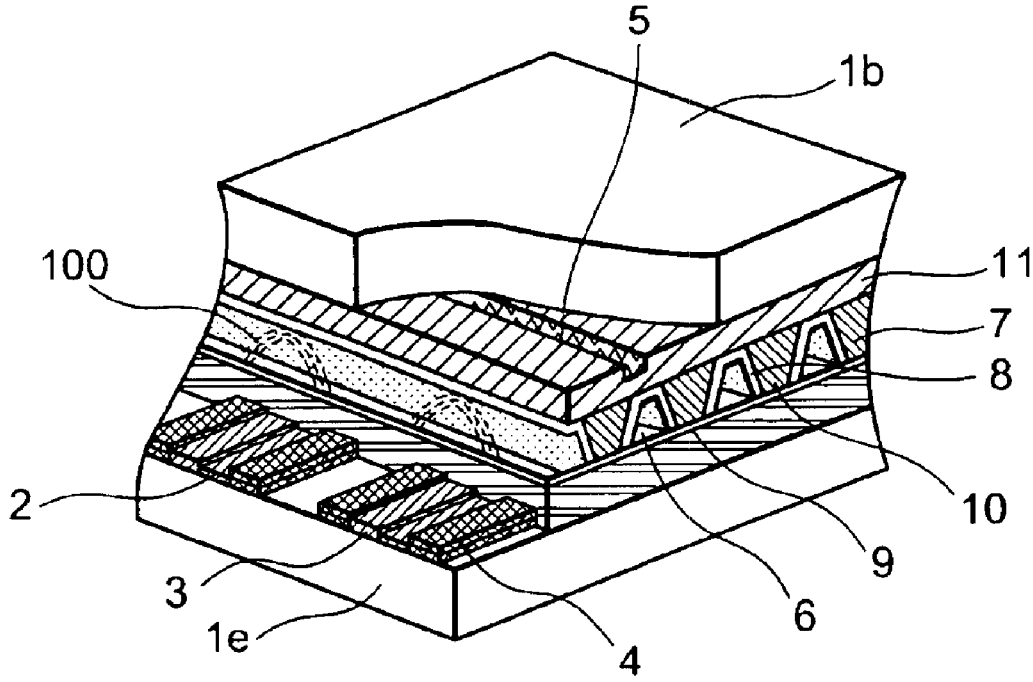
FIG. 1 (PRIOR ART)
FIG. 1 is a sectional view showing a main part in the structure of a conventional type plasma display panel.
Figure 2:
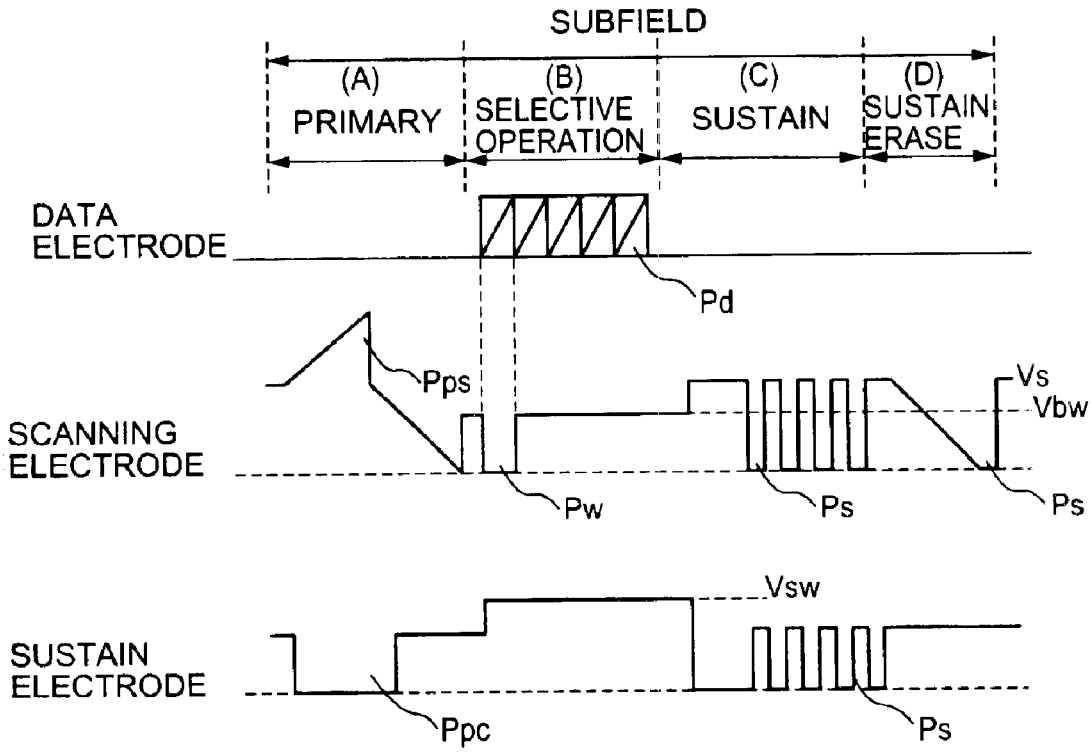
FIG. 2 (PRIOR ART)
FIG. 2 is a timing chart showing a conventional type method of driving the plasma display panel.
Figure 3:
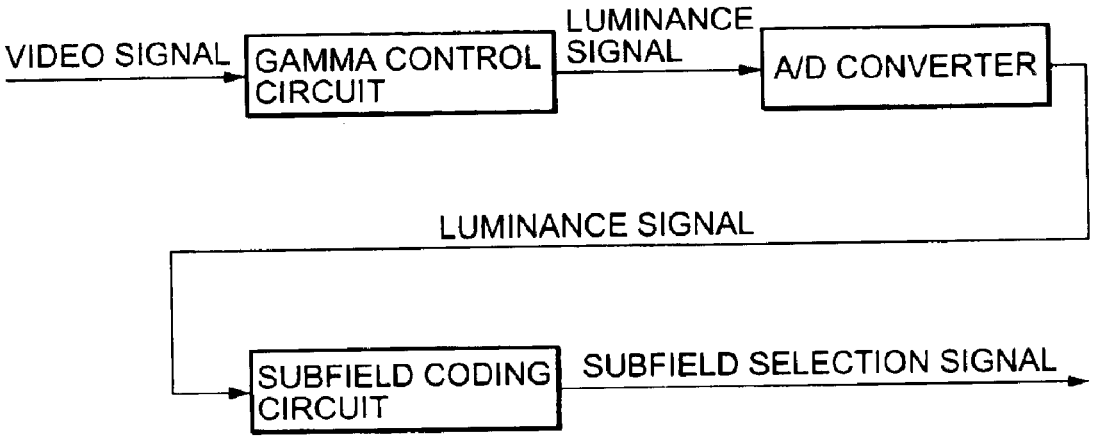
FIG. 3 (PRIOR ART)
FIG. 3 is a block diagram showing the operation of a conventional type circuit for converting a video signal.
Figure 4:
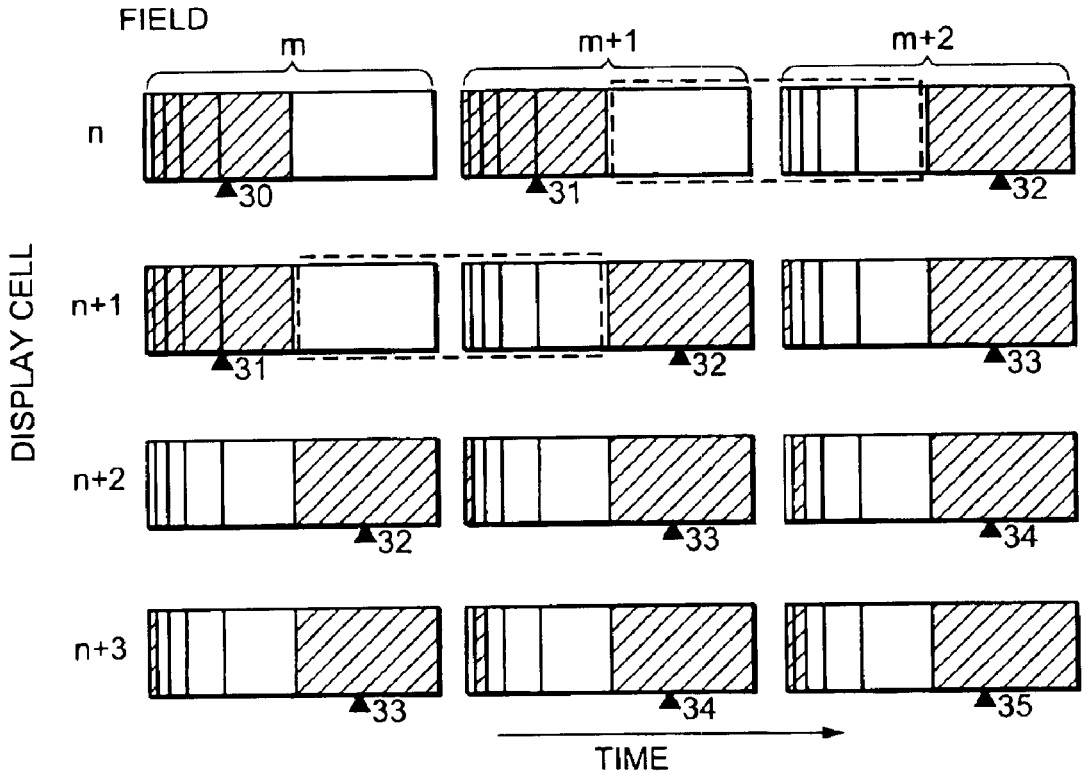
FIG. 4 (PRIOR ART)
FIG. 4 is a time chart showing a conventional type principle of the occurrence of a false contour of an animation.
Figure 5:
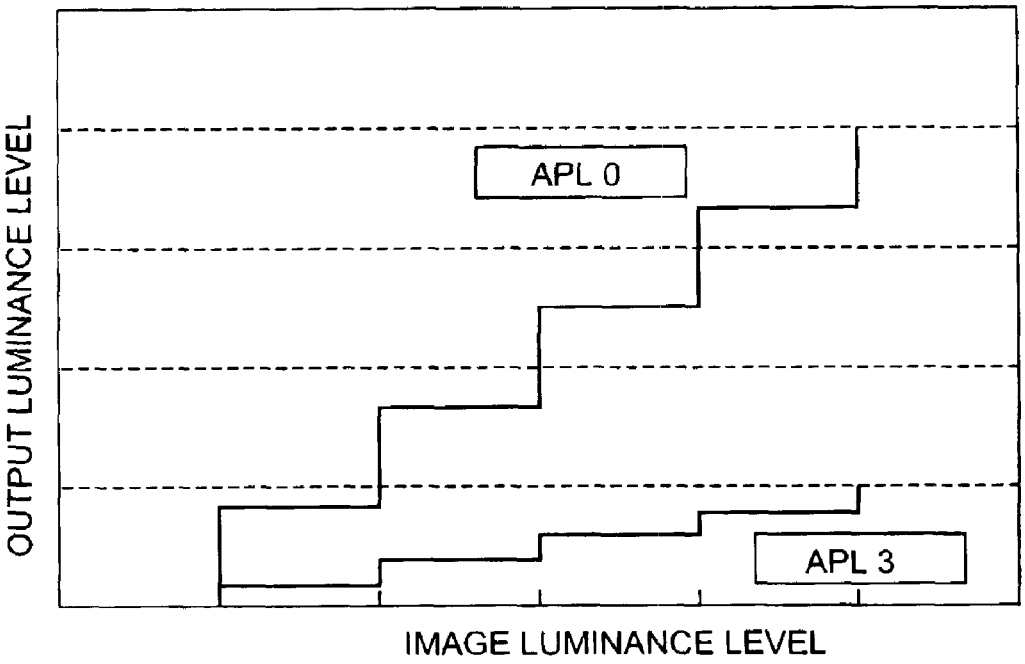
FIG. 5 (PRIOR ART)
FIG. 5 is a graph showing relation between a luminance level of an image on a conventional type plasma display and output luminance.

The basic configuration of a plasma display panel driven according to a method of controlling the luminance of the display panel equivalent to this embodiment is similar to that of the plasma display panel described in the prior art and as shown in FIG. 1, one discharge cell 12 is provided to the intersection of one scanning electrode 2, one sustain electrode 3 and one data electrode 5 perpendicular to these. The driving waveform is also similar to that of the conventional type plasma display and gradation is represented by varying the quantity of emission in a sustain period and combining subfields each of which includes a priming period, a selective operational period, the sustain period and a sustain elimination period.

Next, the weighting of the luminance of each subfield for gradation representation according to the invention will be described.

Table 2 shows relation between the number of sustain cycles of each subfield according to an average luminance level (APL) of an image and the total number of sustain cycles in one field.

TABLE 2

| APL | SF1 | SF2 | SF3 | SF4 | SF5 | SF6 | SF7 | SF8 | SF9 | SF10 | SF11 | SF12 | Total |
|---|---|---|---|---|---|---|---|---|---|---|---|---|---|
| 3 | 1 | 2 | 4 | 8 | 12 | 16 | 21 | 26 | 32 | 38 | 44 | 51 | 255 |
| 2 | 1 | 2 | 4 | 8 | 16 | 28 | 41 | 54 | 68 | 82 | 96 | 111 | 511 |
| 1 | 1 | 2 | 4 | 8 | 16 | 30 | 54 | 79 | 104 | 130 | 156 | 163 | 767 |
| 0 | 1 | 2 | 4 | 8 | 16 | 32 | 64 | 102 | 140 | 179 | 218 | 257 | 1023 |

Figure 6:
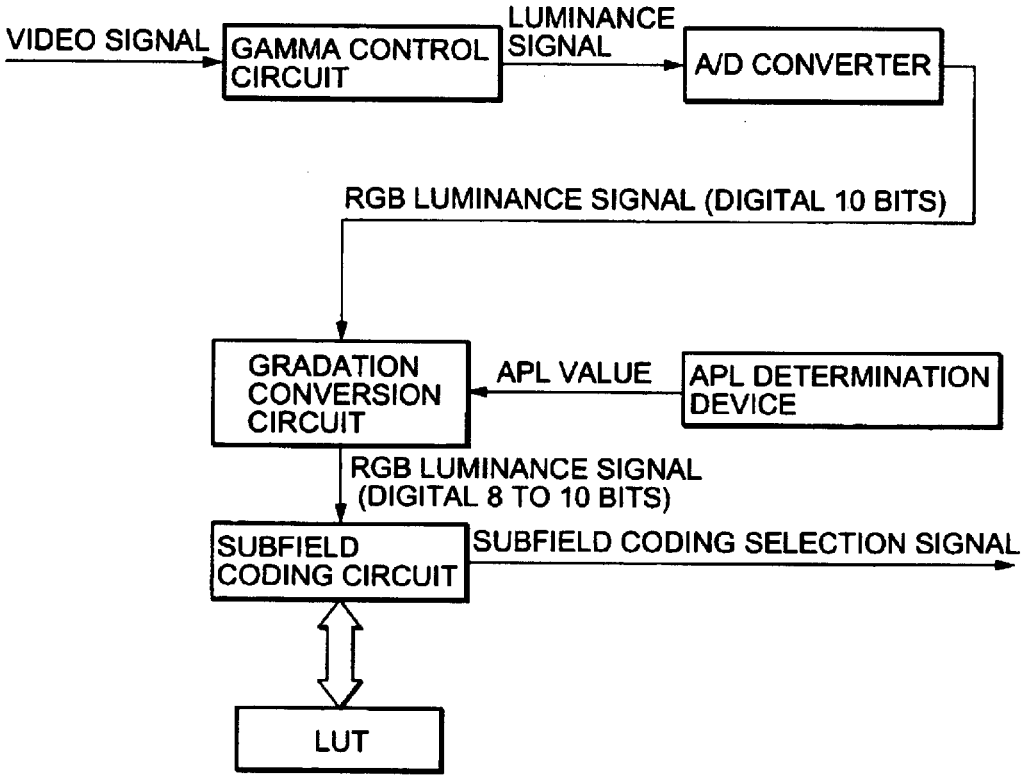
FIG. 6 is a block diagram showing the operation of a circuit for converting a video signal used in one embodiment of a method of controlling the luminance of a display panel according to the invention.

Next, the operation of a circuit for converting a video signal to a signal for driving the plasma display panel will be described. FIG. 6 is a block diagram showing the operation of the circuit used in this embodiment for converting a video signal.

As a video signal for a cathode-ray tube is transmitted in a state having gamma characteristics, an output level is first controlled in a gamma control circuit for the plasma display panel having no gamma characteristic as an output characteristic.

Next, the luminance level of each color of RGB is converted to a digital signal by an A/D converter. In this embodiment, it is converted to a 10-bit binary code.

Afterward, the luminance level of each pixel is added by an APL determination device and APL is determined.

Next, the conversion of a gradation according to each APL value is made in a gradation conversion circuit.

In the case of weighting based upon the number of sustain cycles as shown in Table 2, when APL is high, the gradation representation of 256 gradations (8 bits) is enabled at APL 3 for example as heretofore.

In the meantime, when APL is low, the number of representable gradations increases.

For example, at APL 2, representation in 512 gradations (9 bits) is enabled, at APL 1, representation in 768 gradations is enabled and further, at APL 0, representation in 1024 gradations (10 bits) is enabled.

Therefore, in the gradation conversion circuit, the number of gradations is adjusted based upon APL.

In the case of APL 0, a 10-bit luminance signal is output as it is.

In case APL is high, the number of gradations is reduced according to the respective numbers of gradations.

Concretely, in case APL is 1, the least-significant bit of original 10 bits is deleted and 9-bit data has only to be output.

Luminance data output from the gradation conversion circuit is sent to a subfield coding circuit and there, the selective state of a subfield according to each APL is determined.

Actually, the above operation is realized by having LUT for coding every APL.

The effect of the improvement of image representation by the above operation will be described below.

According to this embodiment, the luminance of SF1 which is at the lowest luminance level is always fixed without depending upon APL and is the minimum luminance level representable on the plasma display panel.

Therefore, a luminance step for gradation representation of an image at APL 0 on a relatively dark screen though peak luminance is high can be also reduced.

Figure 7:
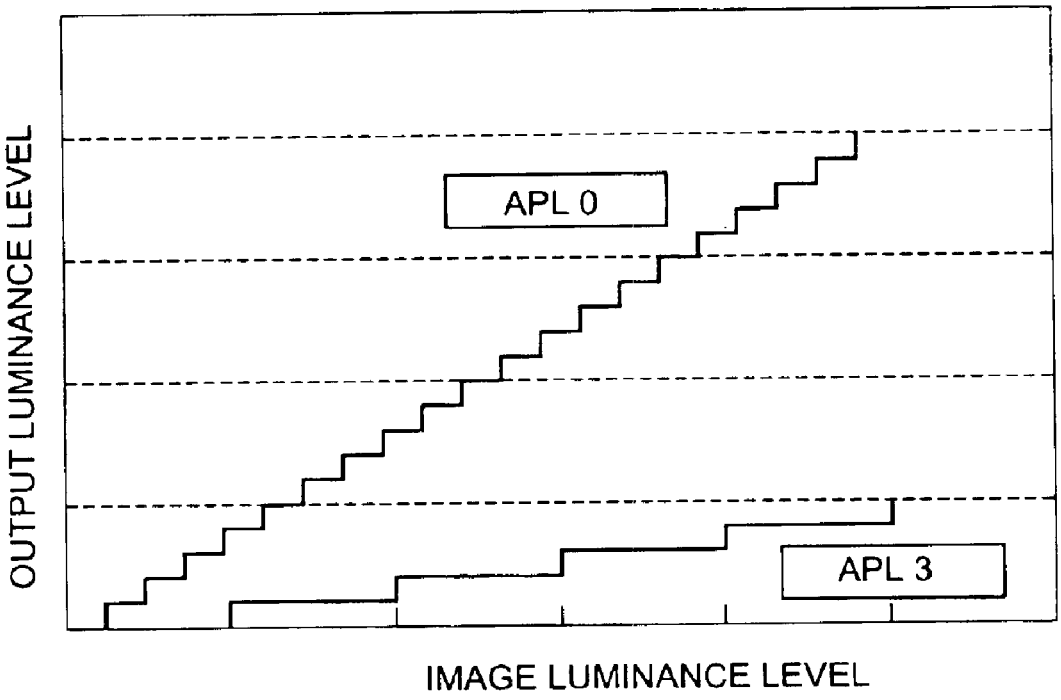
FIG. 7 is a graph showing relation between a luminance level of an image on a plasma display and output luminance in one embodiment of the method of controlling the luminance of the display panel according to the invention.

FIG. 7 is a graph showing relation between the luminance levels of images at APL 0 and at APL 3 and actually output luminance.

In FIG. 7, only a part of low luminance is displayed.

The smoothness of gradation in a particularly dark image is improved by reducing a step of luminance as described above and a more natural image can be represented.

Further, an effect upon a false contour of an animation will be described.

Generally, the more the number of subfields is for the number of bits for gradations, that is, the higher redundancy is, the more a false contour of an animation is improved.

Therefore, in case the number of gradations is increased as in this embodiment, performance related to a false contour of an animation may be deteriorated.

However, a false contour of an animation is originally remarkably seen in a relatively light image having smooth gradation.

Such an image can be said an image the APL of which is relatively high.

In the meantime, in a dark image as a whole in a part of which a light part exists and the APL of which is low, a false contour of an animation is hardly recognized.

Therefore, as subfield coding the redundancy of which is high is applied to an image the APL of which is high and a false contour of an animation of which often appears and subfield coding the redundancy of which is low is applied to an image the APL of which is low and a false contour of an animation of which hardly appears if the luminance control method equivalent to this embodiment is used, the whole performance against a false contour of an animation is hardly deteriorated.

In this embodiment, after A/D conversion, the circuit for determining APL is used, however, a circuit for determining APL based upon an analog signal and converting from analog to digital may be also used.

A method of complementing a gradation after 8 bits are converted from analog to digital, executing temporal and spatial multi-gradation processing such as the error diffusion in the case of APL 3 and executing multi-gradation processing in which luminance at an intermediate level and processing such as the error diffusion are combined at APL 2 or less can be also applied.

However, even if APL is low, performance against a false contour of an animation may be deteriorated when the redundancy of subfield coding is reduced depending upon an image.

Therefore, an embodiment in case the further improvement of performance against a false contour is required will be described below.

Second Embodiment

A plasma display panel driven in this embodiment and the basic driving waveform are also similar to those in the first embodiment. The number of subfields for gradation representation is also similarly 12.

In the meantime, values shown in Table 3 are used for the weighting of the luminance of each subfield for gradation representation.

Table 3 shows relation between the number of sustain cycles of each subfield according to an average luminance level (APL) of an image and the total number of sustain cycles in one field.

TABLE 3

| APL | SF1 | SF2 | SF3 | SF4 | SF5 | SF6 | SF7 | SF8 | SF9 | SF10 | SF11 | SF12 | Total |
|---|---|---|---|---|---|---|---|---|---|---|---|---|---|
| 3 | 1 | 2 | 4 | 8 | 12 | 16 | 21 | 26 | 32 | 38 | 44 | 51 | 255 |
| 2 | 1 | 2 | 4 | 8 | 16 | 28 | 41 | 54 | 68 | 82 | 96 | 111 | 511 |
| 1 | 2 | 4 | 8 | 16 | 32 | 48 | 64 | 82 | 100 | 118 | 138 | 156 | 766 |
| 0 | 2 | 4 | 8 | 16 | 32 | 56 | 82 | 108 | 136 | 164 | 192 | 222 | 1022 |

If the weighting of luminance shown in Table 3 is used, the representation of 256 gradations is enabled at APL 3 as in the first embodiment, the representation of 384 gradations is enabled at APL 1 and the representation of 512 gradations is enabled at APL 2 and APL 0.

When such weighting is used, the redundancy of subfield coding is deteriorated by one bit.

As the redundancy is deteriorated by two bits in the first embodiment, performance against a false contour is more improved than that in the first embodiment.

In the meantime, as for the gradation representation of an image the APL of which is low, the minimum luminance level is 2 at APL 0, the gradation representation is improved because the luminance step is reduced to a half or less compared with that in the conventional type driving method.

Though half luminance is not enough for independent gradation representation, it is very effective in case a halftone is temporally and spatially represented by the combination with the error diffusion and others and is effective as a method of holding performance against a false contour of an animation and improving gradation representation.

Third Embodiment

In this embodiment, a method of inhibiting the deterioration of a false contour of an animation by another method will be described.

A plasma display panel driven in this embodiment and the basic driving waveform are also similar to those in the first embodiment.

The number of subfields for gradation representation is also similarly 12.

Further, values for the weighting of the luminance of each subfield for APL are also similar to the values shown in Table 2 as in the first embodiment.

Next, Table 4 shows relation between a luminance level of an image acquired by an A/D converter and an output luminance level in the case of APL 0.

The luminance levels are all represented by 10 bits (0 to 1023).

TABLE 4

| Image luminance level | 0 | 1 | 2 | 3 | 4 | 5 | 6 | 7 | 8 |
|---|---|---|---|---|---|---|---|---|---|
| Output luminance level | 0 | 1 | 2 | 3 | 4 | 5 | 6 | 7 | 8 |
| 252 | 253 | 254 | 255 | 256 | 257 | 258 | 259 | 260 | |
| 262 | 263 | 264 | 266 | 267 | 267 | 269 | 269 | 261 | |
| 508 | 509 | 510 | 511 | 512 | 513 | 514 | 515 | 516 | |
| 509 | 509 | 511 | 511 | 515 | 515 | 515 | 515 | 519 | |
| 1016 | 1017 | 1018 | 1019 | 1020 | 1021 | 1022 | 1023 | | |
| 1019 | 1019 | 1019 | 1019 | 1023 | 1023 | 1023 | 1023 | | |

As shown in Table 4, when a luminance level of an image is 0 to 255, a luminance step of output is 1, when it is 256 to 511, a luminance step of output is 2 and further, when it is 512 or more, a luminance step of output is 4.

In other words, at a luminance level exceeding intermediate luminance, a luminance step is equivalent to 8 bits.

A human visual sense is very sensitive to the change of luminance at low luminance, however, when the absolute value of luminance is large, it is difficult to discriminate small difference in luminance.

Therefore, in case a minute luminance step can be represented in a low luminance region as described above, the deterioration of gradation is hardly recognized even if a step of the change of luminance becomes large in a high luminance region.

If the luminance step is 4 as in this embodiment, it is similar to the luminance step at APL 0 in the conventional type luminance control method and it can be said that there is no deterioration of gradation.

Next, a method of inhibiting the deterioration of performance against a false contour of an animation will be described.

A false contour of an animation is caused because the selection/the non-selection of a subfield having large weight changes in case an image having smooth gradation moves or a sight is moved.

In the concrete, in the case of an image the gradation of which changes from the 760th gradation to the 780th gradation for example in case a luminance step is 1 at all gradations at APL 0, the selection of s subfield at the 766 gradation is represented as (111111111110) and the selection of a subfield at the 767th gradation is represented as (100110111101) (in this case, an emitted subfield is represented as 1 and an unemitted subfield is represented as 0).

At the 766th gradation, the center of the gravity of emission is located near to a front half of a field and at the 767th gradation, the center of the gravity of emission is located relatively near to a rear half because largely weighted SF12 is selected.

Therefore, the maximum false contour of an animation occurs in parts having the 766th gradation and the 767th gradation.

As described above, a false contour of an animation is caused by the temporal movement of the center of the gravity of emission by the change of the selection/the non-selection of a subfield at a high luminance level.

According to this embodiment, at a luminance level exceeding the 512th gradation, a luminance step is 4.

Therefore, an output luminance level is like 759, 763, 767 and 771.

The selection of a subfield at the 763th gradation is represented as (001111111110) and the center of the gravity of emission moves on the rear side of a field, compared with the 766th gradation.

Therefore, the movement of the center of the gravity of emission is less in the arrangement of the 763th gradation and the 767th gradation, compared with that in the arrangement of the 766th gradation and the 767th gradation, and a false contour of an animation is greatly improved.

In this embodiment, a luminance step in a high luminance region is 4 equivalent to 8 bits, however, in actual display, in consideration of correlation with a visual sense characteristic, a luminance step can be also set to a further large luminance step.

In each luminance region, a luminance step is not required to be set to an equal interval and a method of arbitrarily selecting a used gradation except a gradation at which a false contour of an animation often occurs can be also applied.

As described above, according to the method of controlling the luminance of the display panel according to the invention, smooth gradation representation is enabled independent of the change of an average luminance level (APL) Particularly, gradation characteristics in a relatively dark image the APL of which is low are improved.

This reason is that a luminance level of a subfield represented as a luminance step is fixed without depending upon APL or the whole change of luminance is inhibited up to smaller change and in an image the APL of which is low, the number of display gradations is increased.

The deterioration of a false contour of an animation is hardly caused tough the number of display gradations is increased and the redundancy of subfield coding is deteriorated.

This reason is that in only an image the APL of which is low, the number of gradations is increased.

Further, the deterioration of performance against a false contour of an animation can be inhibited by combining method of inhibiting the deterioration of redundancy and a method of disusing a gradation at which a false contour of an animation often occurs for display.

What is claimed is:

1. A method of controlling the luminance of a display panel, comprising:

dividing a field into a plurality of subfields, wherein a number of sustain cycles is assigned to each subfield;

assigning one of at least two luminance levels to the field and the plurality of subfields therein based on the average luminance level of input image data;

representing gradation by selecting whether each subfield is to be displayed or not; and varying the peak luminance of the field according to the luminance level thereof;

wherein:

the rate of change between the number of sustain cycles assigned to a subfield when assigned a low luminance level and the number of sustain cycles of the same subfield when assigned a high luminance level is smaller for subfields having a lower number of sustain cycles overall than for subfields having a greater number of sustain cycles overall.

2. The method of controlling the luminance of a display panel according to claim 1, wherein:

the rate of change between the number of sustain cycles assigned to a subfield when assigned a low luminance level and the number of sustain cycles assigned to the same subfield when assigned a high luminance level is zero for one or more subfields having a low number of sustain cycles overall.

3. The method of controlling the luminance of a display panel according to claim 1, wherein:

the number of sustain cycles assigned to subfields having a low number of sustain cycles overall is set according to a binary system.

4. A method of controlling the luminance of a display panel according to claim 1, wherein:

a range of display gradations made by selecting whether each subfield is to be displayed or not is determined separately for each luminance level.

5. The method of controlling the luminance of a display panel according to claim 4, wherein:

when input image data has a low average luminance level all displayable gradations are used; and when input image data has a high average luminance level, only a portion of all displayable gradations is used.

6. The method of controlling the luminance of a display panel according to claim 1, wherein the display panel is a plasma display panel.

* * * * *

US006922181C1

(12) INTER PARTES REEXAMINATION CERTIFICATE (0122nd)

United States Patent

Tanaka et al.

(10) Number: US 6,922,181 C1

(45) Certificate Issued: Dec. 8, 2009

(54) METHOD OF CONTROLLING LUMINANCE OF DISPLAY PANEL

(75) Inventors: Yoshito Tanaka, Tokyo (JP); Tadashi Nakamura, Tokyo (JP)

(73) Assignee: Pioneer Corporation, Meguro-Ku, Tokyo (JP)

Reexamination Request:
No. 95/000,338, Jan. 15, 2008

Reexamination Certificate for:

| | |
|---|---|
| Patent No.: | **6,922,181** |
| Issued: | **Jul. 26, 2005** |
| Appl. No.: | **10/194,051** |
| Filed: | **Jul. 15, 2002** |

(51) Int. Cl.
*G09G 3/28* (2006.01)
*G09G 5/10* (2006.01)

(52) U.S. Cl. ..... 345/63; 345/60; 345/690

(58) Field of Classification Search ..... None
See application file for complete search history.

(56) References Cited

U.S. PATENT DOCUMENTS

| | | | | |
|---|---|---|---|---|
| 6,034,656 | A | 3/2000 | Yamamoto et al. | |
| 6,388,678 | B1 | 5/2002 | Kasahara et al. | 345/690 |
| 7,023,406 | B1 | 4/2006 | Nunomura et al. | |
| 7,071,902 | B1 | 7/2006 | Kawahara | |

FOREIGN PATENT DOCUMENTS

| | | | |
|---|---|---|---|
| JP | 10-222122 | | 8/1998 |
| JP | 11-282402 | A | 10/1999 |
| JP | 2000-322025 | | 11/2000 |
| WO | WO 99/30308 | A1 * | 6/1999 |

* cited by examiner

*Primary Examiner*—Colin M Larose

(57) ABSTRACT

In power saving luminance control that the maximum luminance of one field is varied according to an average luminance level of an image, the luminance of a subfield at the minimum luminance level is fixed to a certain value without depending upon the variation of the maximum luminance of one field. Hereby, even if luminance control that the maximum luminance of one field is enhanced in an image the average luminance level of which is low is made, a gradation characteristic in a low luminance region is improved.

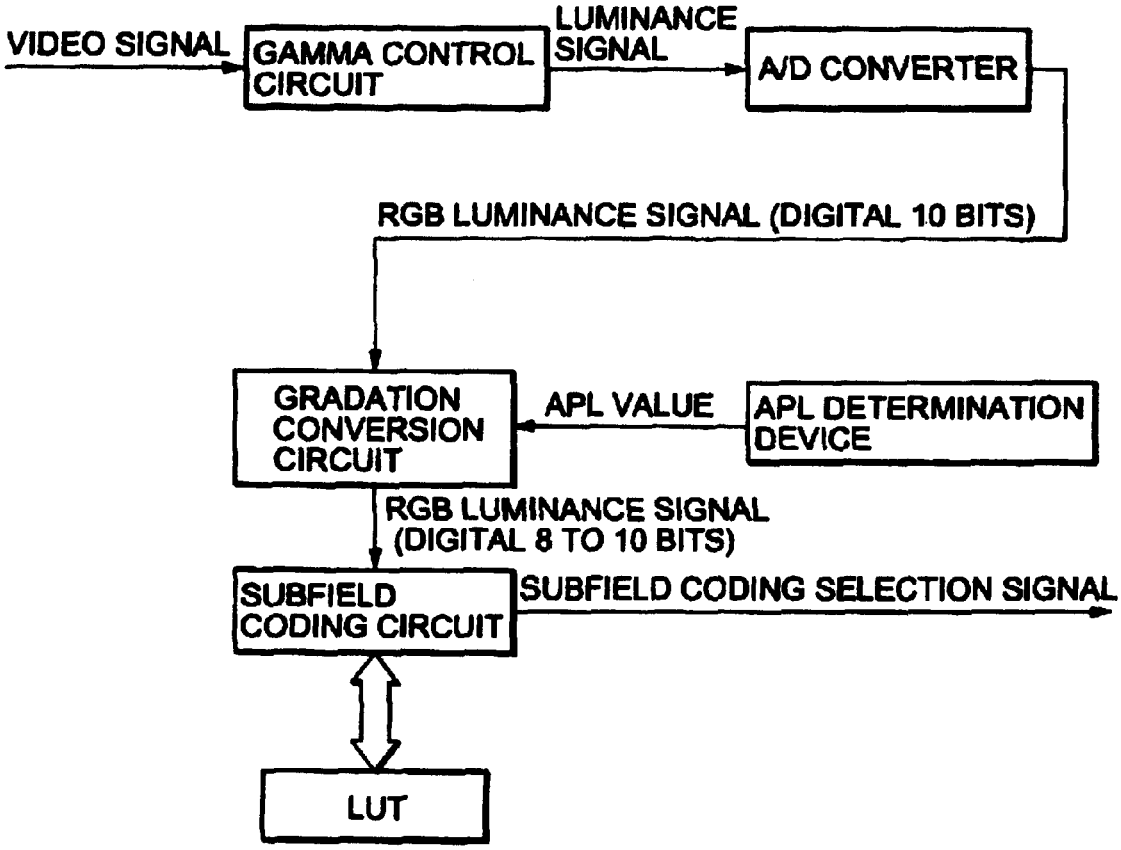

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 1 is determined to be patentable as amended.

Claims 3–6, dependent on an amended claim, are determined to be patentable.

New claims 7–20 are added and determined to be patentable.

1. A method of controlling the luminance of a display panel, comprising:

dividing a field into a plurality of subfields, wherein a number of sustain cycles is assigned to each subfield;

assigning one of at least [two] *three* luminance levels to the field and the plurality of subfields therein based on the average luminance level of input image data;

representing gradation by selecting whether each subfield is to be displayed or not; and varying the peak luminance of the field according to the luminance level thereof;

wherein:

[the] *a relative* rate of change between the number of sustain cycles assigned to a subfield when assigned a low luminance level and the number of sustain cycles of the same subfield when assigned to a high luminance level is smaller for subfields having a lower number of sustain cycles overall than for subfields having a greater number of sustain cycles overall, *and wherein the rate of change between the number of sustain cycles assigned to a subfield when assigned a lowest luminance level and the number of sustain cycles assigned to the same subfield when assigned a highest luminance level is fixed for one or more subfields having a low number of sustain cycles overall, for all luminance levels.*

*7. The method of claim 1 wherein the number of subfields assigned to the field does not vary as the luminance level assigned to the field varies.*

*8. The method of claim 7 wherein a total number of sustain cycles in the subfields of the field generally increases as the luminance level assigned to the field decreases.*

*9. The method of claim 1 wherein the rate of change does not become smaller for subfields having a greater number of sustain cycles when compared to an adjacent subfield having a smaller number of sustain cycles.*

*10. The method of claim 1 wherein the rate of change of each of at least three subfields having the smallest number of sustain cycles is smaller than a rate of change of any other subfield having a larger number of sustain cycles.*

*11. A method of controlling the luminance of a display panel, comprising:*

*dividing a field into a plurality of subfields, wherein a number of sustain cycles is assigned to each subfield;*

*assigning one of at least three luminance levels to the field and the plurality of subfields therein based on the average luminance level of input image data;*

*representing gradation by selecting whether each subfield is to be displayed or not; and*

*varying the peak luminance of the field according to the luminance level thereof;*

*wherein a relative rate of change between the number of sustain cycles assigned to a subfield when assigned a low luminance level and the number of sustain cycles of the same subfield when assigned a high luminance level is smaller for subfields having a lower number of sustain cycles overall than for subfields having a greater number of sustain cycles overall such that the rate of change is largest for a subfield containing a largest number of sustain cycles, and wherein the number of subfields assigned to the field does not vary as the luminance level assigned to the field varies, and the number of sustain cycles in a subfield containing a smallest number of sustain cycles does not vary as the luminance level assigned to the field varies, for all luminance levels.*

*12. The method of claim 11 wherein a total number of sustain cycles in the subfields of the field generally increases as the luminance level assigned to the field decreases.*

*13. The method of claim 11 wherein the rate of change does not become smaller for subfields having a greater number of sustain cycles when compared to an adjacent subfield having a smaller number of sustain cycles.*

*14. The method of claim 11 wherein the rate of change of each of at least three subfields having the smallest number of sustain cycles is smaller than a rate of change of any other subfield having a larger number of sustain cycles.*

*15. A method of controlling the luminance of a display panel, comprising:*

*dividing a field into a plurality of subfields, wherein a number of sustain cycles is assigned to each subfield;*

*assigning one of at least three luminance levels to the field and the plurality of subfields therein based on the average luminance level of input image data;*

*representing gradation by selecting whether each subfield is to be displayed or not; and*

*varying the peak luminance of the field according to the luminance level thereof;*

*wherein a relative rate of change between the number of sustain cycles assigned to a subfield when assigned a low luminance level and the number of sustain cycles of the same subfield when assigned a high luminance level is smaller for subfields having a lower number of sustain cycles overall than for subfields having a greater number of sustain cycles overall such that the rate of change is largest for a subfield containing a largest number of sustain cycles, and wherein the rate of change does not become smaller for subfields having a greater number of sustain cycles when compared to an adjacent subfield having a smaller number of sustain cycles, and the number of sustain cycles in the subfield containing the smallest number of sustain cycles does not vary as the luminance level assigned to the field varies, for all luminance levels.*

*16. The method of claim 15 wherein a total number of sustain cycles in the subfields of the field generally increases as the luminance level assigned to the field decreases.*

*17. The method of claim 15 wherein the rate of change of each of at least three subfields having the smallest number of*

*sustain cycles is smaller than a rate of change of any other subfield having a larger number of sustain cycles.*

*18. A method of controlling the luminance of a display panel, comprising:*

*dividing a field into a plurality of subfields, wherein a number of sustain cycles is assigned to each subfield;*

*assigning one of at least three luminance levels to the field and the plurality of subfields therein based on the average luminance level of input image data;*

*representing gradation by selecting whether each subfield is to be displayed or not; and*

*varying the peak luminance of the field according to the luminance level thereof;*

*wherein:*

*a relative rate of change between the number of sustain cycles assigned to a subfield when assigned a low luminance level and the number of sustain cycles of the same subfield when assigned a high luminance level is smaller for subfields having a lower number of sustain cycles overall than for subfields having a greater number of sustain cycles overall such that the rate of change is largest for a subfield containing a largest number of sustain cycles, and wherein the number of sustain cycles in the subfield containing the smallest number of sustain cycles does not vary as the luminance level assigned to the field varies, for all luminance levels.*

*19. The method of claim 18 wherein a total number of sustain cycles in the subfields of the field generally increases as the luminance level assigned to the field decreases.*

*20. The method of claim 18 wherein the rate of change of each of at least three subfields having the smallest number of sustain cycles is smaller than a rate of change of any other subfield having a larger number of sustain cycles.*

* * * * *